US005524693A

United States Patent [19]

Hamilton

[11] Patent Number: 5,524,693

[45] Date of Patent: Jun. 11, 1996

[54] FLEXIBLE PARTITION

[76] Inventor: Roy S. Hamilton, 1460 Lakeshore, Dorval, Quebec, Canada, H9S 2E7

[21] Appl. No.: 432,956

[22] Filed: May 1, 1995

Related U.S. Application Data

[63] Continuation-in-part of Ser. No. 66,500, May 24, 1993, Pat. No. 5,429,171.

[51] Int. Cl.[6] ..... A47H 1/00

[52] U.S. Cl. ..... 160/243; 160/120; 160/268.1; 160/310

[58] Field of Search ..... 160/243, 244, 160/245, 242, 120, 121.1, 241, 268.1, 310, 41, 188, 189

[56] References Cited

U.S. PATENT DOCUMENTS

| | | |
|---|---|---|
| 669,321 | 3/1901 | Holwager et al. . |
| 1,003,045 | 9/1911 | Hartsough . |
| 1,307,729 | 6/1919 | Dunlop . |
| 3,521,693 | 7/1970 | Kuss . |
| 3,537,504 | 11/1970 | Deane . |
| 3,693,695 | 9/1972 | Deane . |
| 3,900,063 | 8/1975 | Roller . |
| 4,298,048 | 11/1981 | Roller . |
| 4,417,185 | 11/1983 | Bullat . |
| 4,436,137 | 3/1984 | Charles . |
| 4,480,675 | 11/1984 | Berkemeier . |
| 4,651,940 | 3/1987 | Nakamura . |
| 4,691,957 | 9/1987 | Ellingson . |
| 4,987,942 | 1/1991 | Eriksson . |
| 5,195,594 | 3/1993 | Allen et al. . |

FOREIGN PATENT DOCUMENTS

| | | |
|---|---|---|
| 2260348 | 6/1974 | Germany . |

*Primary Examiner*—David M. Purol
*Attorney, Agent, or Firm*—Wolf, Greenfield & Sacks

[57] ABSTRACT

A flexible partition suspended from a ceiling of a gymnasium or the like. The flexible partition includes a drive cylinder which extends the length of and intermediate the curtain forming the partition. The cylinder is provided with a drive motor internally of the cylinder, and a reaction device is provided externally of the curtain such that the motor device when activated will drive the cylinder to wind up the upper and lower portions of the curtain. The upper and lower portions of the curtain are attached at diametrically opposed locations on the cylinder, and hook and loop type fastening strips are provided on the edges of the curtain and the side walls so as to seal the curtain against noise or dust.

3 Claims, 5 Drawing Sheets

FLEXIBLE PARTITION

CROSS-REFERENCE TO RELATED APPLICATION

This application is a continuation-in-part application of application Ser. No. 08/066,500, filed May 24, 1993 now U.S. Pat. No. 5,429,171.

BACKGROUND OF THE INVENTION

1. Field of the Invention

The present invention relates to a flexible partition, and more particularly, to a curtain with an integrated wind-up device.

2. Description of the Prior Art

It is well known to utilize flexible sheet type curtains, which are adapted to be rolled up, to divide or partition a large room such as a gymnasium. Such curtains might easily measure 40 feet in length by 20 feet in height. In most cases, an electric motor drives a shaft on which the curtain is hung. Such an apparatus is described in U.S. Pat. No. 3,900,063, issued Aug. 19, 1975 to Max F. Roller. As can be seen in the Roller patent, the installation of such a curtain may be relatively involved since the motor and roll-up device must be mounted to the trusses or rafters supporting the ceiling. The torque required to wind up the complete curtain is substantial, thereby increasing the height of the wind-up installation.

A further disadvantage of current flexible partition wall systems is that they do not lend themselves to being properly sealed against dust or noise. In other words, there is no suitable device for sealing the vertical edges of the curtain against the walls forming the enclosure or room which is being divided by the curtain when it is deployed.

SUMMARY OF THE INVENTION

It is an aim of the present invention to provide an improved, relatively light, flexible partition for dividing large rooms such as gymnasiums.

It is a further aim of the present invention to provide a flexible partition which is simpler to install.

It is a still further aim of the present invention to provide a flexible partition which can completely divide a room and be sealed against the lateral walls defining the room so as to reduce the transmission of sound or dust between the two divided portions.

A construction in accordance with the present invention comprises at least a flexible partition for dividing a room wherein the room includes a ceiling, a floor and vertical side limiting means defining a vertical planar area. The flexible partition has dimensions to cover the vertical planar area and includes a curtain with a top edge, means for suspending the curtain from the ceiling, a bottom edge touching the floor when the curtain is fully deployed, and side edges in contact with the respective vertical limiting means. An elongated cylinder extends from one side edge to the other and is fixedly connected to the curtain and divides the curtain in upper and lower portions. A motor means is located with at least one end of the cylinder, at one edge of the curtain, rotary drive means is mounted within the cylinder and is driven by the motor means to rotate the cylinder, and torque reacting means is provided adjacent the one edge of the curtain and associated with the motor means to resist rotation of the motor means with the cylinder in response to rotation of the rotary drive means whereby the upper and lower portions of the curtain will be wound up on the cylinder when it is required to roll up the curtain.

More specifically, the cylinder includes a circular cross-section interrupted by diametrically opposed grooves. Beads are provided at a lower edge of the upper portion and an upper edge of the lower portion for fitting and locking into the respective diametrically opposed grooves such that the cylinder is bisected by a common plane of the upper and lower portions of the curtain when the curtain is fully deployed.

In a more specific embodiment, the torque reacting means is in the form of an arm fixed to the motor means exterior of the cylinder and at a right angle to the axis of the cylinder, including winding means associated with the arm, and a flexible sheet suspended from the ceiling parallel to the upper portion of the curtain. The flexible sheet is windable onto the winding means in a rotational direction such as to counteract the torque transmitted to the arm.

In a still more specific embodiment of the present invention, the side edges of the curtain and the respective side limiting means are each provided with elongated cooperating hook and loop type fastening strips in order to seal the side edges of the curtain when it is deployed.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
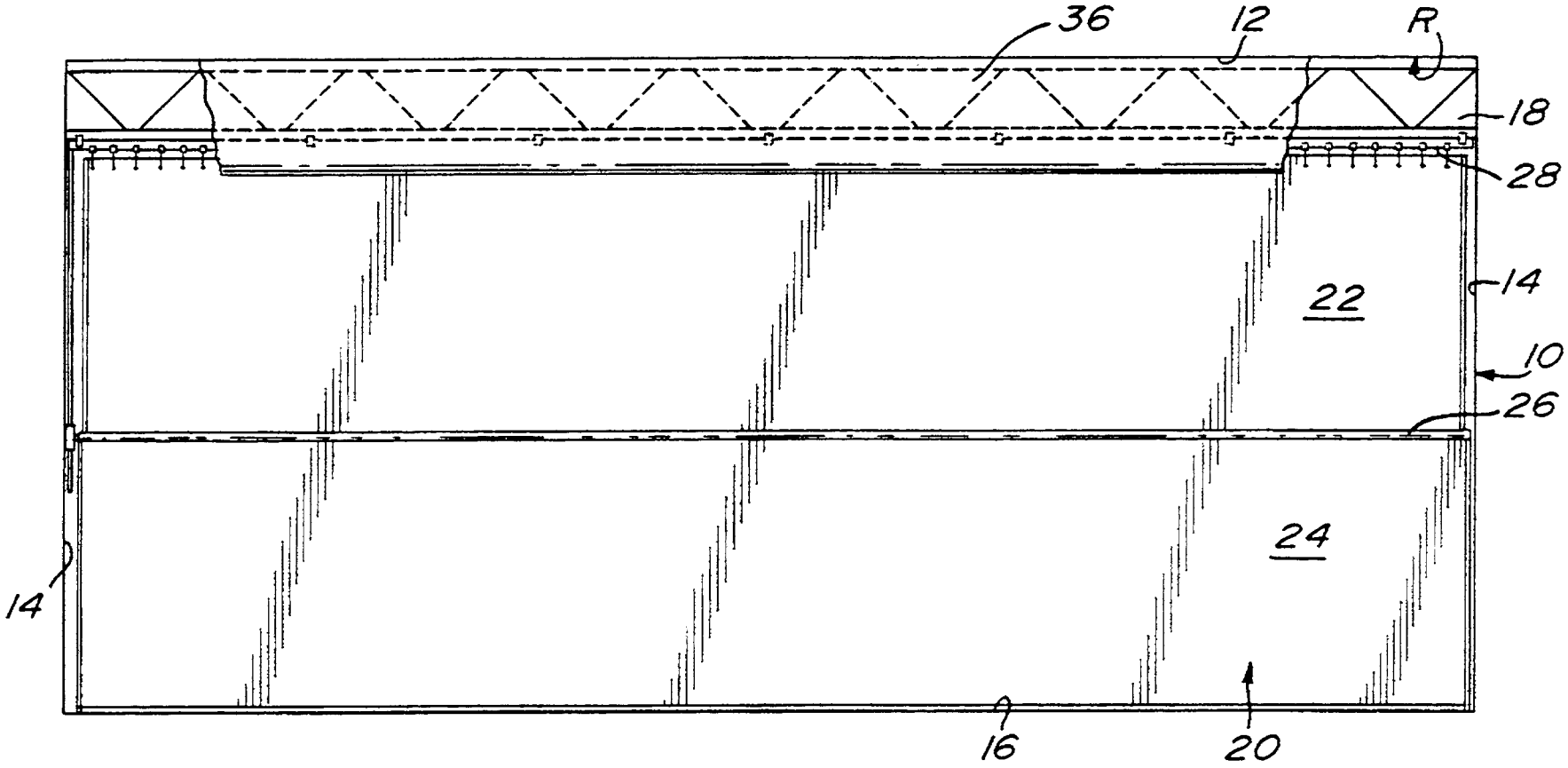
FIG. 1 is a front elevation of the flexible partition fully deployed.
Figure 2:
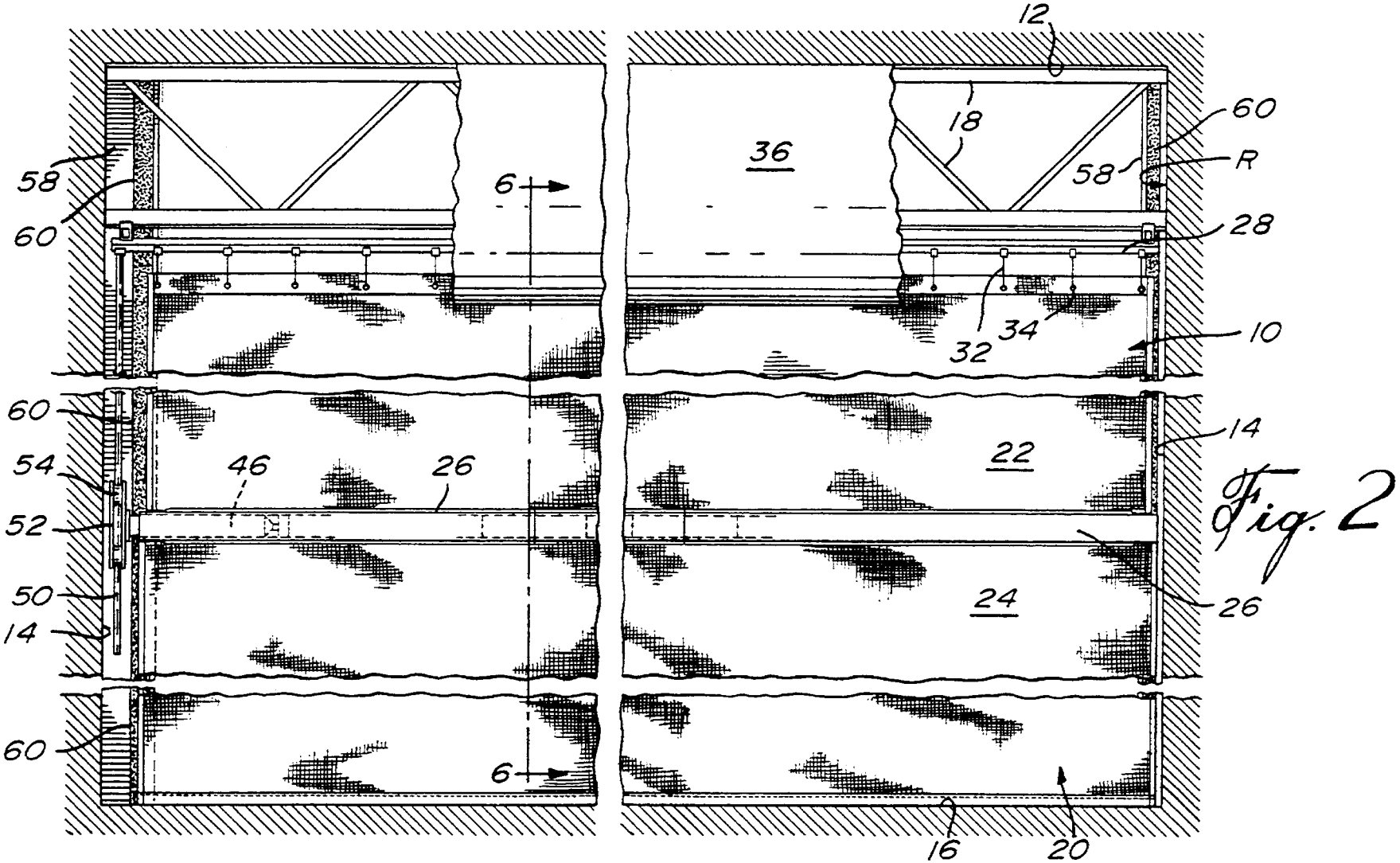
FIG. 2 is a fragmentary enlarged front elevation, similar to FIG. 1.

Referring to FIGS. 1 and 2, there is shown a flexible partition 10 being fully deployed in a room R. The room R might be a gymnasium or other large room such as in an industrial factory or a convention hall. The room R includes a ceiling 12, a floor 16, and side walls 14. In the present embodiment, the partition 10 is shown as being hung from a truss girder 18 extending from one wall 14 to the other lateral side wall 14 and supporting the ceiling 12.

The flexible partition includes a curtain 20 which in this case is made up of an upper portion 22 and a lower portion 24. A cylinder 26 separates the upper portion 22 from the lower portion 24 as will be described further. The flexible curtain 20 might be made up of 18 oz. reinforced polyester in vinyl or reinforced nylon in urethane.

Figure 3:
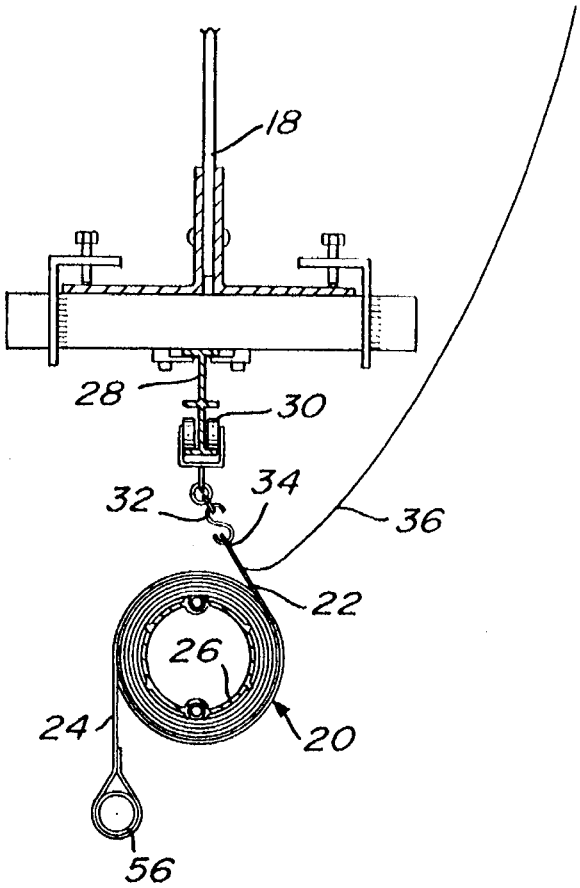
FIG. 3 is a vertical cross-section, taken laterally of the flexible partition fully wound up.

Referring now to FIG. 3, the upper edge of the curtain 20 is suspended from the girder 18 by means of a track 28. Roller brackets 30 each include hangers 32 which fit in grommets 34 provided near the upper edge of the upper portion 22 of the curtain 20.

Figure 6:
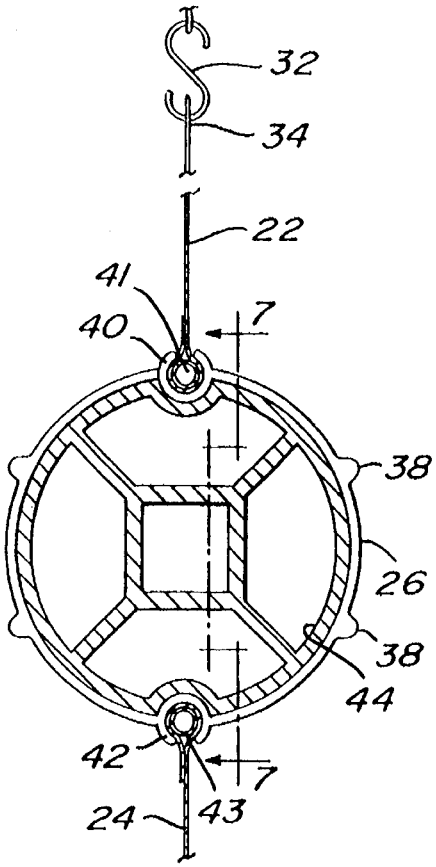
FIG. 6 is a fragmentary vertical cross-section, taken along line 6—6 of FIG. 2.

The wind-up cylinder 26 may be a thin walled aluminum extrusion including longitudinally extending ribs 38 and a pair of diametrically opposed grooves 40 and 42 adapted to receive respective beads 41 and 43 of the upper portion 22 and lower portion 24 respectively. As shown in FIG. 6, the configuration of the grooves and the beads allows the beads 41 and 43 to be locked into the grooves 40 and 42.

Figure 4:
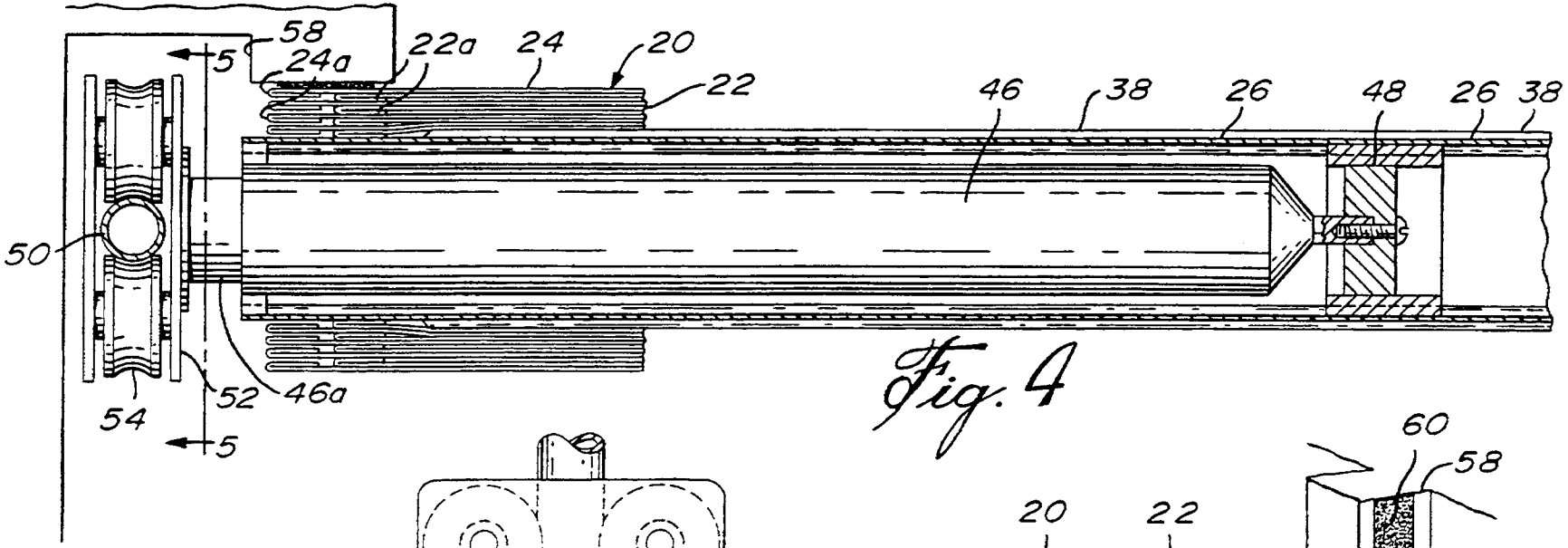
FIG. 4 is an enlarged fragmentary longitudinal cross-section of a detail of the flexible partition.

As can be seen in FIG. 4, the ends of the ribs 38 are tapered and cut away near the ends of the cylinder 26, in order to accommodate the hems 22*a* and 24*a* and the fastening strip at the edges of the curtain 20.

Figure 7:
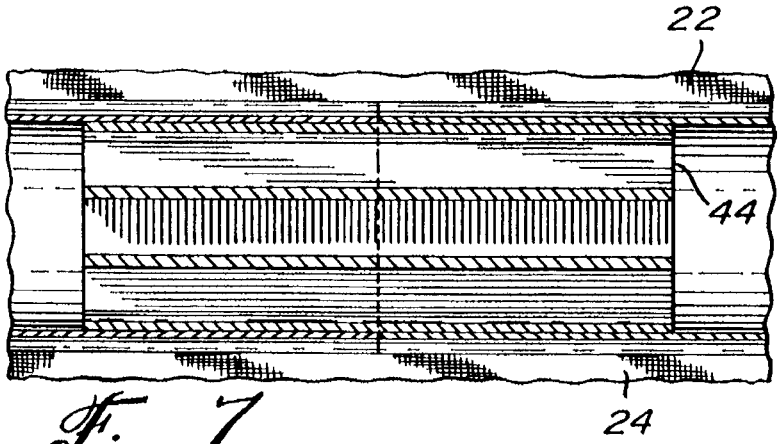
FIG. 7 is a vertical axial cross-section, taken along line 7—7 of FIG. 6.

The cylinder 26 may be supplied in 20-foot sections, and the sections are connected end to end by inserts 44 having a slightly smaller diameter than the cylinder 26. The insert 44 is shown in FIG. 7 as well as in FIG. 6.

A motor 46 is provided within the hollow portion of the cylinder at least at one end of the cylinder 26 and includes a rotary drive connection 48 as shown in FIG. 4, and the other end of the motor is connected by means of an extension 46*a* to a carriage 52 which in turn mounts four idler wheels 54. The idler wheels 54 are adapted to surround a suspended tube 50. When the motor 46 is driven to rotate the cylinder 26 by means of the rotary drive connection 48, the reaction is to resist the torque and thus to prevent the rotation of the motor provided by the carriage 52 on the suspended tube 50. It is contemplated that other torque reaction devices could be used including a fixed vertical guide member, a folding torque arm, fixed guide wires, or a retractable cable.

Figure 9:
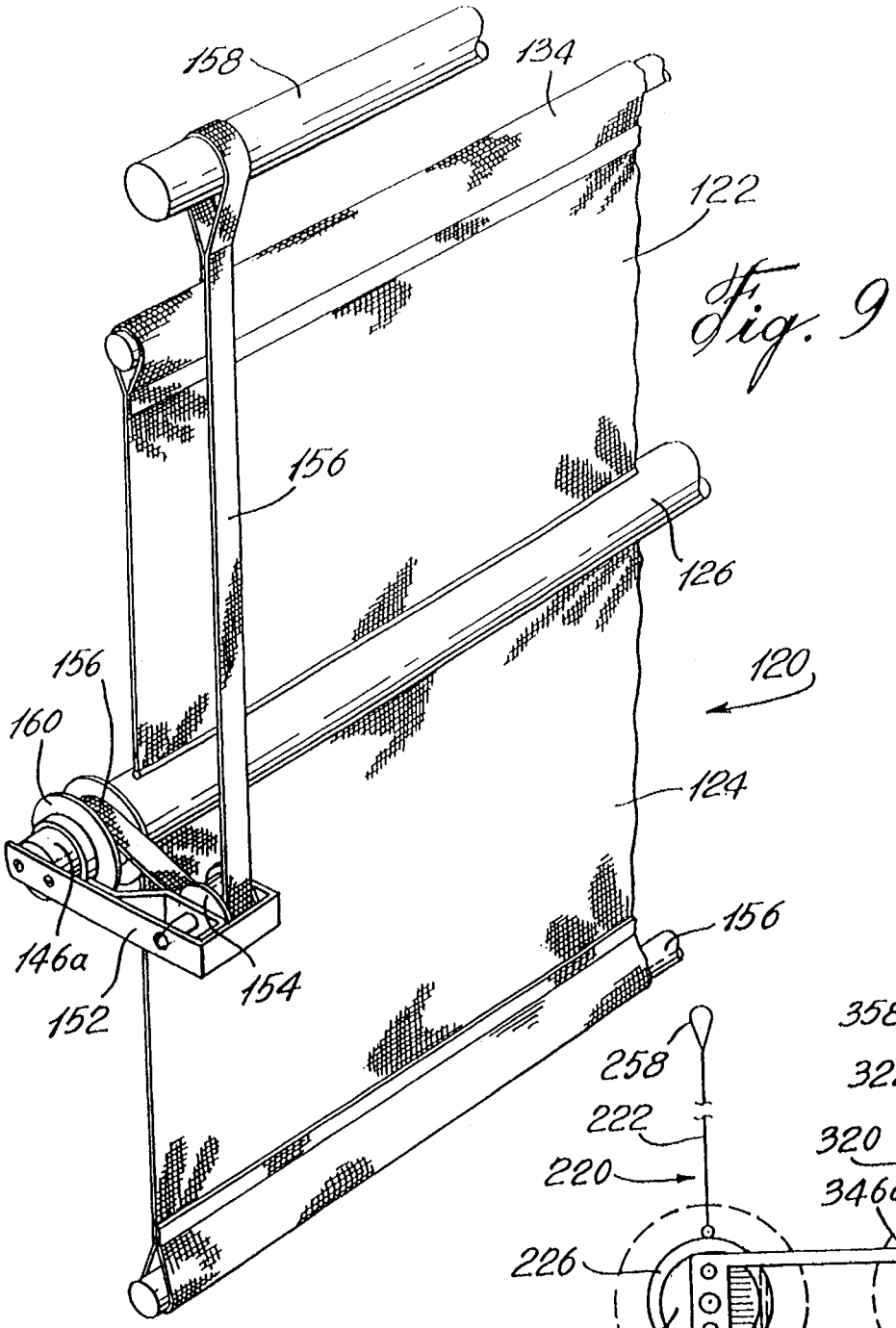
FIG. 9 is a fragmentary perspective view of another embodiment of a detail of the present invention.

Referring now to FIG. 9, another embodiment of the torque reacting means is shown. In this embodiment, the curtain 120 is shown including upper and lower portions 122 and 124 fixed at diametrically opposed locations on the cylinder 126. The cylinder 126 extends beyond the end of the edge of the curtain and mounts a pulley 160 fixed to the cylinder 126, as will be described. An arm in the form of a bracket 152 is attached to the end of the motor shaft extension 146*a*. A flexible band 156 is suspended from the ceiling on rod 158. The flexible band passes around a pulley 154 in the bracket 152 and then onto the pulley 160 which is fixed to the cylinder 126. As the cylinder 126 is being wound in the counterclockwise direction, the torque reaction of the motor and motor extension 146 would be to rotate in the clockwise direction and thus transmit this torque through the arm bracket 152. However, the flexible band 156 passes under the pulley 154 in the bracket and is being wound on the cylinder 126 by means of pulley 160. Thus, the length of band 156 is shortened as the cylinder rolls up on the curtain. The length reduction of band 156 between the rod 158 and the roller 154 will correspond to the length reduction of the upper portion of the curtain 122.

Figure 10:
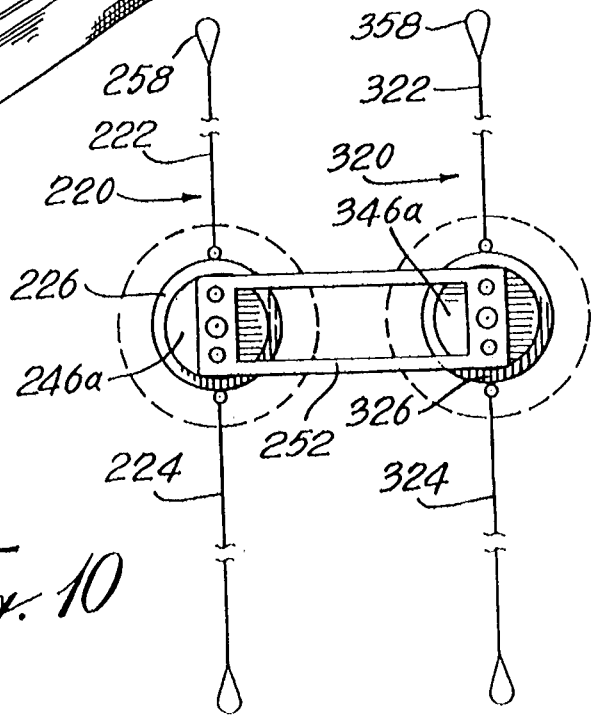
FIG. 10 is an end elevation of still another embodiment of a detail of the present invention.

In the embodiment shown in FIG. 10, a double curtain system 220 and 320 is illustrated. The bracket arm is shown at 252 and is fixed to the motor shaft extension 246*a* in the case of curtain 220 and 346*a* in the case of curtain 320. Both curtains 220 and 320 are suspended from the ceiling at 258 and are identical other than the fact that the motors will rotate the cylinders 226 and 326 in opposite directions. When cylinder 226 is rotated in a clockwise direction, the torque reaction of the motor transmitted through the shaft 246*a* and the arm 252 is to rotate in the counterclockwise direction. However, since the cylinder 326 is rotating in the counterclockwise direction, the reaction of the motor shaft extension 346*a* transmitted to the arm 252 is to rotate in the clockwise direction, thereby counteracting the torque of the shaft 246*a*. Thus, the curtains would be wound up simultaneously while using a single bracket 252 to react to the torque from the different motors.

It is also contemplated that in the case of heavy curtains, two motors 46 would be required, one at each edge of the curtain 20.

In operation, when it is required to wind up the curtain, the motor 46 is activated to rotate the rotary drive connection 48 and thus rotate the cylinder 26. Both the upper portion 22 and the lower portion 24 of the curtain 20 will simultaneously be rolled up on the cylinder 26 as the cylinder 26 climbs on the upper portion 22.

A weight 56 may also be provided at the lower edge of the lower portion 24 in order to properly hang the curtain 20.

Figure 8:
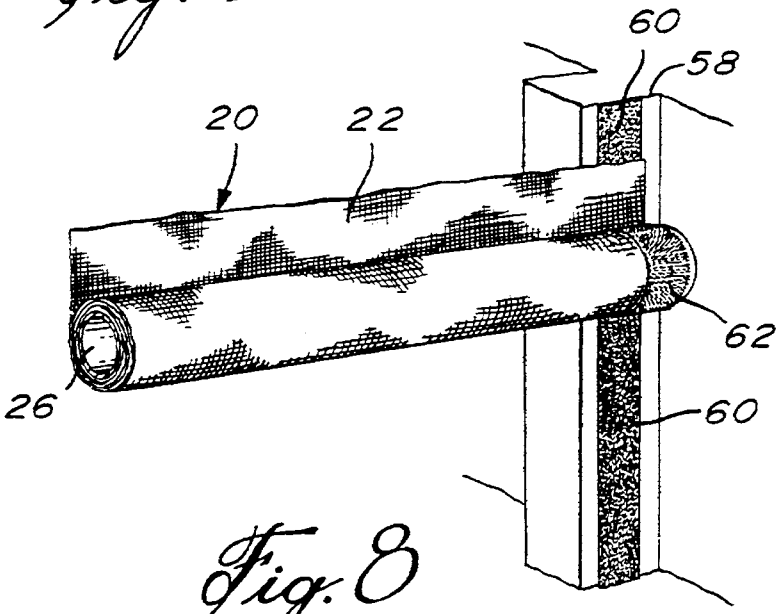
FIG. 8 is a fragmentary perspective view of the flexible partition being deployed.
Figure 5:
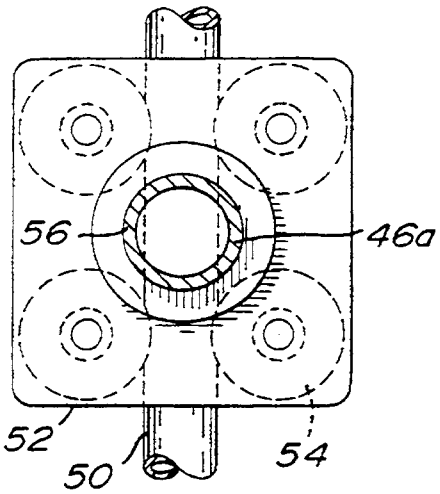
FIG. 5 is a vertical cross-section, taken along line 5—5 of FIG. 4.

In rooms where it is required to acoustically seal one divided portion from another, or where it is important to minimize the transfer of dust, it has been found advantageous to provide complementary strips of hook and loop fastening material 60 and 62 on the edges of the curtain 20 and on an alcove 58 formed on the walls 14. In such an embodiment, the wind-up cylinder 26 should be located at the bottom edge of the curtain. As shown in FIGS. 4 and 8, the curtain is easily deployed as the cylinder 26 unwinds and lays the curtain against the hook or loop strip 60 on the alcove 58. Likewise, when it is required to wind up the curtain 20, the cylinder 26 is wound up thereby stripping the curtain from the strip 60.

A valance 36 may be suspended from the ceiling 12 and connected to the upper edge of the upper portion 22 of the curtain 20, as shown in FIGS. 1, 2, and 3. The valance 36 may be provided on either side of the partition.

I claim:

1. A flexible partition for dividing a room, wherein the room includes a ceiling, a floor, and vertical side limiting means defining a vertical planar area, comprising at least a flexible curtain having dimensions to cover the vertical planar area and including a top edge, means for suspending the curtain from the ceiling, a bottom edge touching the floor when the curtain is fully deployed, and side edges adjacent the respective vertical limiting means, an elongated cylinder extending from one side edge of the curtain to the other fixedly connected to the curtain and dividing the curtain into an upper and lower portion, motor means located within the cylinder at least at one side edge of the curtain, rotary drive means driven by the motor means and connected to the cylinder, an arm fixed to the motor means exterior of the cylinder and at a right angle to the axis of the cylinder, winding means associated with the arm, a flexible sheet suspended from the ceiling parallel to the upper portion of the curtain, said flexible sheet being windable onto the winding means in a rotational direction as the curtain is being wound on the cylinder whereby to counteract the torque transmitted from the motor means through the arm.

2. A flexible partition as defined in claim 1, wherein the cylinder extends beyond the end edge of the curtain and mounts a pulley fixed thereto, said arm mounts an idler pulley spaced from the axis of the cylinder, and a flexible band is suspended from the ceiling parallel to the upper portion of the curtain and passes around said idler pulley to be wound on the pulley mounted to the cylinder such that as the cylinder winds the curtain and shortens the length of the upper portion of the curtain, the band is also wound on the pulley mounted to the cylinder to proportionally shorten the band and offer torque resistance to the arm and, therefore, the motor.

3. A flexible partition as defined in claim 1, wherein a pair of identical flexible curtains are suspended from the ceiling in side by side parallel relationship, and said arm extends and is fixed to the motor means in each suspended curtain, motor means in each curtain and adapted to provide opposite rotation to the respective curtain such that the arm resists the torque of each motor means as the curtains are being wound up.

* * * * *